United States Patent [19]

Valuikas et al.

[11] Patent Number: 4,709,921

[45] Date of Patent: Dec. 1, 1987

[54] WEIGHTED INSOLE

[76] Inventors: Antonette G. Valuikas; Ralph Valuikas, both of 2098 Highwood Ave., St. Paul, Minn. 55119

[21] Appl. No.: 836,439

[22] Filed: Mar. 5, 1986

[51] Int. Cl.[4] ..... A63B 23/04; A64B 21/18

[52] U.S. Cl. ..... 272/119; 272/96; 36/44; 36/132

[58] Field of Search ..... 272/96, 119; 36/44, 36/43, 132

[56] References Cited

U.S. PATENT DOCUMENTS

| | | | |
|---|---|---|---|
| 2,461,355 | 2/1949 | Supple | 36/43 X |
| 2,953,862 | 9/1960 | Majer | 36/43 X |
| 3,306,610 | 2/1967 | Biggs et al. | 272/57 |
| 3,517,928 | 7/1969 | Shanahan | 272/119 |
| 3,922,801 | 12/1975 | Zente | 36/44 |
| 4,252,315 | 2/1981 | Kimura | 272/119 |

FOREIGN PATENT DOCUMENTS

| | | | |
|---|---|---|---|
| 18208 | 9/1899 | New Zealand | 272/96 |

*Primary Examiner*—Richard J. Apley
*Assistant Examiner*—David J. Bender
*Attorney, Agent, or Firm*—Merchant, Gould, Smith, Edell, Welter & Schmidt

[57] ABSTRACT

A weighted shoe insert (1) comprising a weighted base member (3), formed either as an integral portion of a shoe (8) or as a discrete insert sandwiched between an upper adhesively backed cover (2) and a lower adhesively backed cover (4). The base member 3 contains a series of perforations (28) and edge contours (17) which facilitate the shaping of the base member to conform with the human foot. In a second preferred embodiment, the base member is composed of a series of discrete elements (92) in which chafing between adjacent segments has been substantially reduced by the contouring of the edges (202*a*).

5 Claims, 5 Drawing Figures

FIG. 1
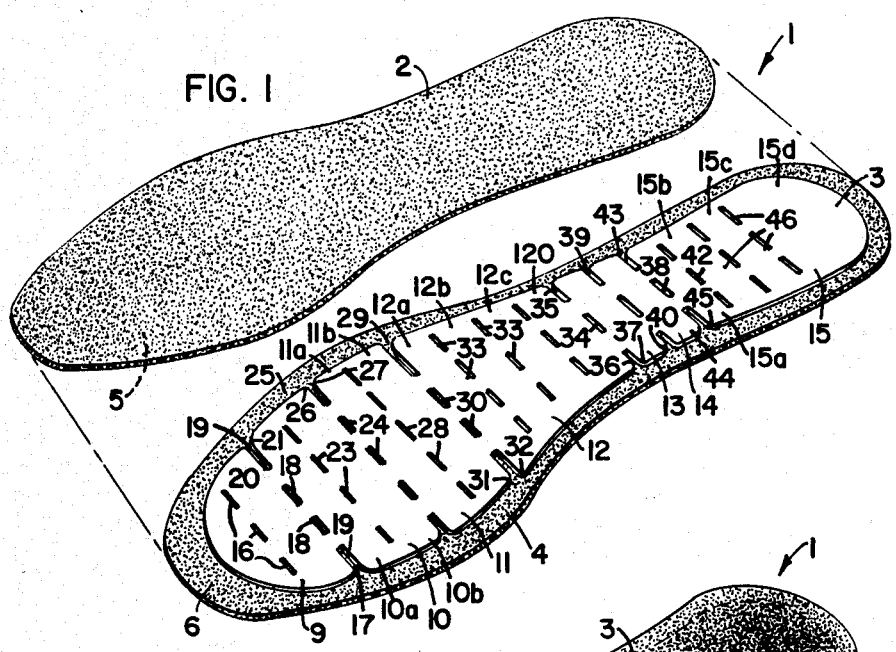
FIG. 2
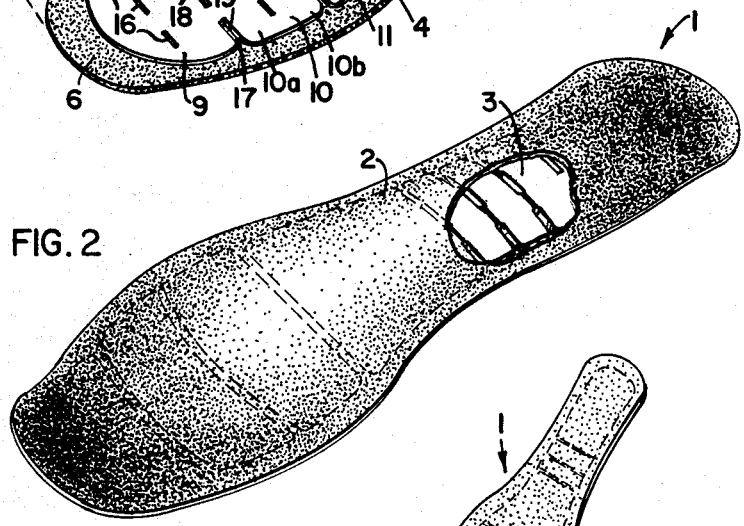
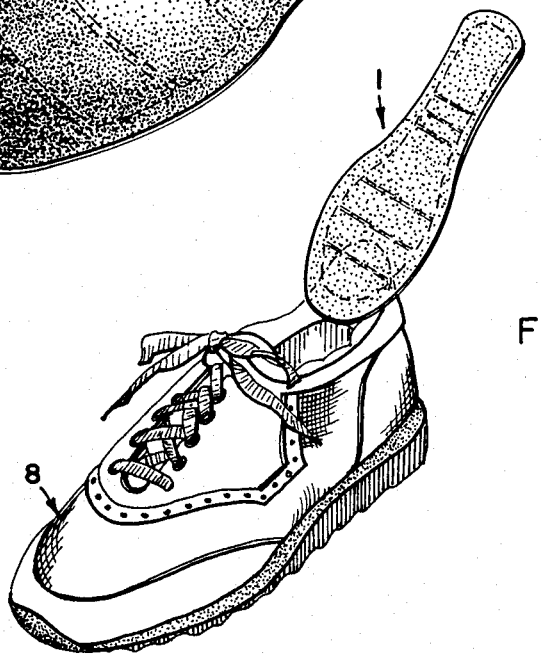
FIG. 3

WEIGHTED INSOLE

BACKGROUND OF THE INVENTION

1. Field of the Invention

This invention relates generally to a weighted insert for use with shoes in order to make the shoe relatively more massive, thereby tending to strengthen the legs, ankles and feet of the wearer. More specifically, the device according to the present invention relates to an improved configuration of a weighted insole.

2. Description of Related Technology

The use of weighted shoes, or weighted shoe accessories, is well known in the prior art for the purpose of strengthening human leg muscles. When an athlete trains or exercises the legs and feet in a normal manner without the use of abnormally massive shoes, the strengthening of the legs and feet reaches a plateau beyond which no further improvement may be achieved. The addition of weights to the shoes, ankles or lower legs forces the development of stronger muscles which could not be achieved through other normal training methods.

An example of a weighted shoe accessory is disclosed in U.S. Pat. No. 3,306,610, issued to Biggs. Biggs discloses a pair of spats which are placed around the shoe and which contain weights or pockets at various locations such that the amount of weight and its location may be varied according to the needs of the user. While the Biggs device achieves its goal of applying additional weight to the wearer's feet, it suffers the drawbacks of being both asethetically unacceptable and relatively inconvenient to install and remove. The Biggs device requires that it be placed on the external surface of the shoe and secured by lacing, the lacing being necessarily relatively elaborate in order to prevent the weights from shifting when in use. The configuration of the Biggs device is such that its removal is required whenever the shoe is being used in a non-weight training context, since its appearance is very conspicuous and is incompatible with any sort of stylish appearance.

An improved weight training device is disclosed in U.S. Pat. No. 4,252,315, issued to Kimura. Kimura addresses the problems created by the Biggs device by placing the weight in an insert which is placed on the insole of a shoe. The Kimura device suffers from the drawbacks of being insufficiently flexible so as to cause discomfort to the wearer's feet, since it is unable to conform to the individual wearer's foot contour. Additionally, a configuration as disclosed by Kimura results in uncontrolled stress fractures and chafing, the chafing creating sharp burrs on adjacent edges of the base metal. This chafing eventually results in tearing of the padded material surrounding the base metal and, in extreme cases, penetration of the wearer's foot. The rigidity and chafing of the Kimura device tends to make its use quite uncomfortable after a short period of time.

SUMMARY OF THE INVENTION

An object of the present invention is to provide an improved apparatus and method for facilitating the use of a relatively massive insole insert for weight training purposes.

The improved weighted insole insert of the present invention addresses the problems of the prior art by placing a specially configured base metal, such as lead, between two sheets of a soft, adhesive-backed polymer material. The lead base material is formed with a series of lateral perforations extending across substantially the entire width, the base metal being shaped substantially as a plan outline of a human foot. When first placed in use, the base metal comprises a single, integral member but, within approximately fifteen (15) minutes, the shape of the foot is molded into the lead. The lead is immediately flexible because of the novel method of cutting and perforating the base metal. The lead does eventually break but such breakage is not necessary for comfort or flexibility.

Thus, after a period of time the base metal becomes deformed by the pressure of the foot so as to conform to the contours of the foot, and is broken at periodic intervals as defined by the perforations so as to be flexible along its longitudinal axis.

Another object of the present invention is to reduce the chafing between separated segments of the base metal by contouring the edges of the base metal so as to minimize interedge contact. The edges of the adjoining segments are rounded and the shape and placement of the perforations are so configured as to substantially reduce any tendency for adjacent pieces of the base metal to come into contact with each other to the extent required to create a sharp edge or burr. In furtherance of this object, the adhesive used in affixing the base metal to the polymer backing material is carefully selected so as to retard any sliding tendency of the base metal segments while retaining their ability to flex freely about the lines of intersection defined by the perforations.

BRIEF DESCRIPTION OF THE DRAWINGS

FIG. 1 is a perspective view of a weighted insole according to the present invention, showing in expanded fashion the upper covering material.

FIG. 2 is a perspective view of the weighted insole of FIG. 1 with the top covering in place and a section broken away to reveal details of the internal structure.

FIG. 3 is a perspective view showing a weighted insole as shown in FIG. 1 being inserted into a show.

DESCRIPTION OF THE PREFERRED EMBODIMENT

Figure 4:
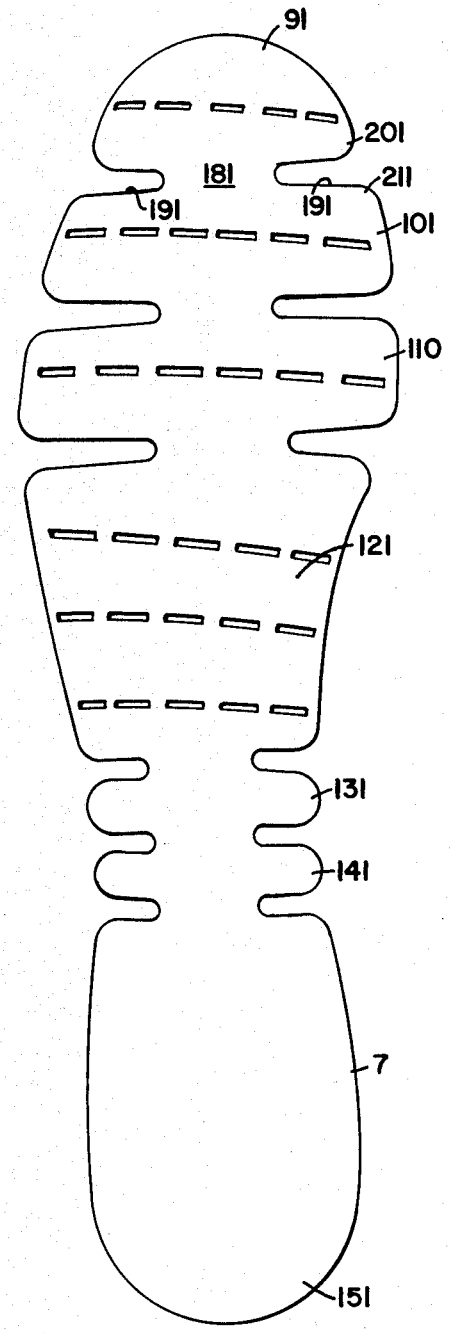
FIG. 4 is a plan view of the base metal according to the invention of FIG. 1.

Referring now more particularly to the drawings, the weighted insole insert of this invention is shown in FIGS. 1 and is generally indicated by reference numeral 1. The apparatus of this invention has a top cover 2, a weighted member 3, and a bottom cover 4.

The top cover 2 and bottom cover 4 are generally comprosed of substantially identical materials, typically a polymer such as polyeurethane foam. The polymer used must be chosen to have certain characteristics that are compatible to the environment in which it will be used, namely inside a shoe, which is being worn by a person engaged in vigorous exercise. Therefore, such a polymer will typically undergo a 25% compression deflection in the range of 17 to 24 pounds per square inch and have a density of approximately 30 to 40 pounds per cubic foot. These characteristics should be maintainable over the temperature range of −40° F. to +200° F. and undergo a linear shrinkage of no more than 5% when subjected to a temperature of 158° F. for seven days. The tensile strength of the polymer used should be no less than 300 pounds per square inch and be capable of an elongation of at least 150%. Since the insert will be used inside the shoe, fungal resistance is important and the polymer used should correspond to either MIL Standard 454 or ASTM Specification G21-70. Polymers meeting these requirements are commercially available.

The base member 3 is sandwiched between top cover 2 and bottom cover 4 and is held in place by means of an adhseive layer placed upon the inner surface 5 of top cover 2 and the inner surface 6 of bottom cover 4. The adhesive serves the important function not only of holding top cover 2 and bottom cover 4 together, but also resists lateral movement of base member 3 during flexing of insole 1.

One novel aspect of the present invention, as best seen in FIGS. 1 and 4, resides in the formation of base member 3. One embodiment of base member 3 is depicted in FIG. 1 whereas a somewhat different type of base member shown as reference numeral 7 is depicted in FIG. 4. Base members 7 and 2 may be constructed of any relatively dense metal such as lead, iron or steel, the more flexible and maleable metals, such as lead, being preferable. Many metals and composites may be formed or laminated in sufficiently thin strips or layers to produce the required flexiblity. Ideally, the base member 3 should be able to conform to all movements of a human foot as well as being able to conform to the shape of the individual human foot when subjected to the pressure of the foot when the insert is in place within a shoe 8.

As seen in FIG. 1, base member 3 is formed as one continuous piece which has been subdivided into a toe member 9, a forward ball segment 10, a rear ball segment 11, a forward arch segment 12, a rear arch segment 13, a forward heel segment 14 and a rear heel segment 15.

Toe portion 9 is bisected laterally by a series of narrow rectangular perforations 16. Perforation 16 promotes flexing of toe segment 9 during use and also tends to define a line of separation along which toe segment 9 will divide if the flexing of base member 3 is sufficient to warrent independent movement between halves of toe member 9.

Toe member 9 is joined to first ball segment 10 along intersection zone 17 which is characterized by two elongated perforations 18 and indentations 19. During normal use of the insert 1, flexing of the foot will cause toe section 9 to separate from forward ball section 19 as cracks develop between indentations 19 and perforations 18. The rear corners 29 of toe segment 9 and the forward corners 21 of forward ball segment 10 are rounded, and the shape of indentations 19 is such that the indentation is narrowest at its tip 22 and widens somewhat as it approaches corners 20 and 21 so that when toe segment 9 separates from front ball segment 10, only a very small surface area of the edge of two segment 9 and forward ball segment 10 actually come into contact, thereby minimizing the chafing and the creation of any burrs due to deformation of the adjacent, abutting materials.

A series of rectangular perforation 23 laterally bisects forward ball segment 10 and represent a line of separation between the two halves of forward ball segment 10 should flexing of base member 3 be so great in normal use as to require independent movement between the two halves 10*a* and 10*b*. Forward ball segment 10 is joined to rear ball segment 11 along a series of elongated perforations 24. Tapered indentations 25 reside at each end of the line of elongated ends 24. In normal use, forward ball segment 10 separates from rear ball segment 11 along a line defined by indentations 25 and perforations 24, thereby permitting independent movement between sections 10 and 11. The rear corners 26 of forward ball section 10 and the forward corners 27 of rear ball segment 11 are rounded and the indentations 25 are tapered such that the edge contact between the separate segments 10 and 11 are minimized during their independent movement when base member 3 is flexed. Thus, chafing and the creation of burrs is minimized by the selection of these particular corner and indentation contourings. A series of elongated perforations 28 laterally bisects rear ball segment 11 thereby permitting the segment to separate into two halves 11*a* and 11*b* should flexing of base member 3 be so severe as to require independent movement of the two halves.

Rear ball segment 11 is joined to forward arch segment 12 along the line defined by tapered indentations 29 and elongated perforations 30. During normal use of insert 1, rear ball segment 4 and forward arch segment 12 separate and move independently from each other. The rear corner 31 of segment 11 and the forward corner 32 of segment 12 are rounded, and indentations 29 are tapered such that the edge contact between separated segments 11 and 12 is minimized thereby reducing chafing and the production of burrs. Note also that the adhesive used on the top surface 6 of bottom cover 4 and the bottom surface 5 of top cover 2 is selected so as to restrain lateral movement of the various segments during use. Thus, even though the segments may be separated, their tendency to slide together, causing abrasion or deformation of the edges, is resisted by the presence of the adhesive.

Forward arch segment 12 is perforated by a series of laterally aligned perforations 33, typically arranged in three parallel rows, which permit forward arch segment 12 to divide into as many as four separate segments 12*a*, 12*b*, 12*c* and 12*d* should the flexing of base member 3 be so great as to require the independent movement of the various segments thus defined.

Forward arch segment 12 is joined to rear arch segment 13 along the line defined by single perforation 34 and tapered indentations 25. In normal use, forward arch segment 12 separates from rear arch segment 13 along the line defined by indentations 35 and perforation 34, thereby permitting independent movement between the adjacent segments. Note that the rear corners 36 of forward arch segment 12 and the forward corners 37 or rear arch segment 13 are rounded, and indentations 35 are tapered, so as to reduce edgewise contact between segments 12 and 13, thereby reducing chafing and the creation of burrs between the adjacent segments.

Rear arch segment 13 is joined to forward heel segment 14 along a line defined by single perforation 38 and tapered indentations 39. In normal use, rear arch segment 13 separates from forward heel segment 14 along the line by indentations 39 and perforation 38, thereby permitting independent movement between the adjacent segments. Note that the rear corners 40 of rear arch segment 13 and the forward corners 41 of forward heel segment 14 are rounded, and indentations 39 are tapered, so as to reduce edgewise contact between segments 13 and 14, thereby reducing chafing and a creation of burrs between the adjacent segments.

Forward heel segment 14 is jointed to rear heel segment 15 along the line defined by single perforation 42 and tapered indentations 43. During normal use of insert 1, forward heel segment 14 and rear heel segment 15 separate and move independently from each other. The rear corner 44 of segment 14 and the forward corners 45 are rounded, and indentations 43 are tapered such that the edge contact between separated segments 14 and 15 are minimized thereby reducing chafing and the production of burrs. Again, the adhesive used on the top surface 6 of botton cover 4 and the bottom surface 5 of top cover 2 is selected so as to restrain lateral movement of the various segments during use.

Rear heel segment 15 is perforated by a series of laterally aligned perforations 46, typically arranged in three parallel rows, which permit rear heel segment 15 to divide into as many as four separate segments **15*a*, 15*b*, 15*c* and 15*d* should the flexing of base member 3** be so great as to require the independent movement of the various segments thus defined.

Referring now to FIG. 4, an alternate embodiment of the base metal is shown at 7. Base metal 7 is divided into a toe portion 91, a forward ball portion 101, a rear ball portion 110 an arch portion 121, segmented forward heel portion 131, middle heel portion 141 and rear heel segment 151. This alternate embodiment is illustrative of the fact that the significant novel feature of the present invention is the rounding and tapering of the corners and indentations which join adjacent segments. Although the rounding and tapering need have no specific contour, the shaping of the joint between adjacent segments must be such as to minimize edge contact when adjacent segments break apart from each other during normal use.

Thus, rear corner 201 of forward segment 91 is rounded and appreciably removed from the forward corner 211 of segment 101. Indentations 191 are contoured so as to provide adequate clearance between adjacent segments 91 and 101 except for bridge 181, which need not have any particular width beyond that needed to ensure structural integrity of the base material 7 during manufacture.

Figure 5:
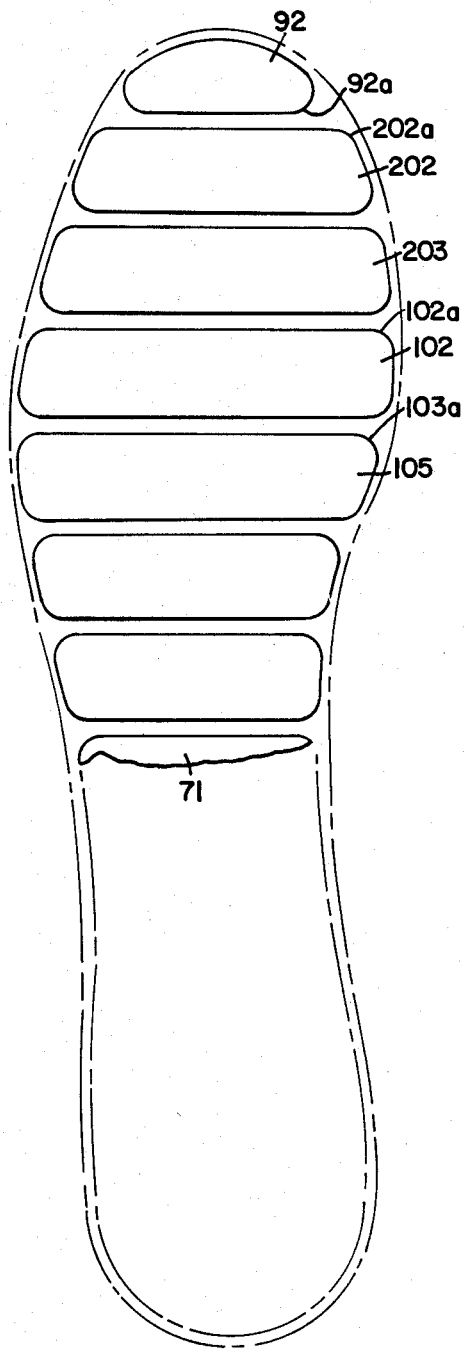

A second alternate embodiment of the present invention is shown in FIG. 5, in which the base material 71 is divided into a number of adjacent segments such as toe segment 92, forward ball segment 202, rear ball segment 203, forward arch segment 102, middle arch segment 103 and rear arch segment 105. In this embodiment, each of the segments may be preformed without any interconnection as shown in the previous two embodiments. Then, the segments may be placed between the adhesive layers 2 and 6 as shown in FIG. 1. The significant feature of this embodiment again resides in the fact that alternate segments may be placed adjacent to each other without difficulty if, and only if, the corners of the adjacent segments are rounded and tapered so as to minimize chafing between adjacent segments. Thus, the embodiment as depicted in FIG. 5 would not function properly if rear corners **92*a* of forward section 92 and forward corners 202*a* of segment 202 were left in the configuration shown regardless of the spacing segments. Sharp, angular corners such as depicted at 92*a* and 202*a* would cause considerable chafing and the production of burrs which would eventually pierce the adhesive coating 2 and 6, and possibly the wearer's foot. Instead, the corners must be rounded and tapered as shown for example at rear corners 102*a* and forward corners 103*a* of adjacent segments 102 and 103**. Again, a particular shaping and contouring is not critical as long as the shaping is performed so as to minimize edge contact between adjacent segments.

The present invention is not limited to the embodiments explained above, but many modifications can be conceived by those skilled in the art within the scope of the invention. In particular, the shaping and the contouring of the base members, regardless of the materials of which they are formed, can take on a variety of shapes.

I claim:

1. A weighted insole adapted to be placed inside of a shoe comprising:

(a) a first sheet of a flexible material having the planform of a shoe sole;

(b) a relatively dense base member, the base member having a planform substantially identical in shape, but somewhat smaller in dimension, than the first sheet of flexible material, the base member possessing a series of lateral perforations, the perforations defining joints within the base member such that the base member has sufficient flexibility to conform to foot movement;

(c) a second sheet of a flexible material having a planform substantially identical to the planform of the first sheet; and (d) an adhesive for securing the first sheet, the base member and the second sheet in a layered relationship such that the base member is permanently constrained between the first and second sheet, the adhesive being applied to the first sheet and the second sheet such that the first and second sheet are secured together and the base member is constrained between the first and second sheet.

2. A weighted insole according to claim 1, wherein the perforations are formed as a plurality of laterally elongated, substantially rectangular stress fractures which may be created in the base member during use to follow a path defined by the elongated perforations.

3. A weighted insole according to claim 2, wherein the base member is subdivided by the perforations into a toe member, a forward ball segment, a rear ball segment, a forward arch segment, a rear arch segment, a forward heel segment, and a rear heel segment, the segments corresponding to naturally occurring stress zones encountered during use.

4. A weight training device according to claim 3, wherein the perforations defining a line separating each of the respective segments terminates as an indentation, the indentation tending to form a gap between each adjacent segment.

5. A weighted insole according to claim 4, wherein the indentation residing at the end of each series of perforations separating adjacent segments is tapered so that separation between adjacent segments is greatest near the perimeter of the base member.

* * * * *

UNITED STATES PATENT AND TRADEMARK OFFICE

CERTIFICATE OF CORRECTION

PATENT NO. : 4,709,921

DATED : December 1, 1987

INVENTOR(S) : Valuikas et al.

It is certified that error appears in the above-identified patent and that said Letters Patent is hereby corrected as shown below:

Column 1, Line 32, for "asethetically" read --aesthetically--.
Column 2, Line 53, for "comprosed" read --composed--.
Column 3, Line 8, for "adhseive" read --adhesive--.
Column 3, Line 19, for "2" read --4--.
Column 3, Line 40, for "warrent" read --warrant--.
Column 3, Line 54, for "two" read --toe--.
Column 6, Line 41, after "rectangular" add --orifices within the base member, thereby encouraging--.
Column 6, Line 60, for "perimeter" read --parameter--.

Signed and Sealed this

Seventh Day of February, 1989

*Attest:*

DONALD J. QUIGG

*Attesting Officer*

*Commissioner of Patents and Trademarks*